United States Patent [19]

Quinn

[11] 4,140,962

[45] Feb. 20, 1979

[54] HIGH VOLTAGE REGULATOR USING LIGHT DEPENDENT RESISTOR

[75] Inventor: Halsey P. Quinn, Rancho Palos Verdes, Calif.

[73] Assignee: Xerox Corporation, Stamford, Conn.

[21] Appl. No.: 804,954

[22] Filed: Jun. 9, 1977

[51] Int. Cl.[2] ..... G03G 15/02

[52] U.S. Cl. ..... 323/21; 250/326; 250/578; 307/146; 355/3 CH

[58] Field of Search ..... 250/326, 355, 552, 578; 307/146, 311; 323/21, 22 Z; 355/3 CH, 68, 69, 70

[56] References Cited

U.S. PATENT DOCUMENTS

| | | | |
|---|---|---|---|
| 3,199,015 | 8/1965 | Lackey et al. | 323/22 Z |
| 3,471,700 | 10/1969 | Presti | 323/21 X |
| 3,604,925 | 9/1971 | Snelling et al. | 323/21 |
| 3,805,069 | 4/1974 | Fisher | 250/326 |

OTHER PUBLICATIONS

Sokoloski et al, "An Automatic Voltage Control Circuit", Rev. Sci. Instrum., vol. 45, No. 2, Feb. 1974, pp. 295, 323–421.

Hudson, "Self Adjusting Corona Device", Xerox Disclosure Journal, vol. 1, No. 2, Feb. 1976, pp. 67, 250–326.

*Primary Examiner*—A. D. Pellinen

*Attorney, Agent, or Firm*—Leonard Zalman

[57] ABSTRACT

A high voltage power supply is regulated using a light dependent resistor. A feedback circuit from the load controls the input to a light emitting diode which is optically coupled to a light dependent resistor connected in series with the load. Increases in the load current tend to reduce illumination on the light dependent resistor, thereby increasing the resistance of that circuit element which reduces the load current. The converse is also true. Regulation may be applied to a D.C. power source or to an A.C. power source by developing a signal indicative of average current level and applying it to the light emitting diode to control the light dependent resistor. The high voltage power control of the invention is particularly useful in regulating corotron voltage levels in a xerographic reproduction device.

8 Claims, 15 Drawing Figures

FIG. 5
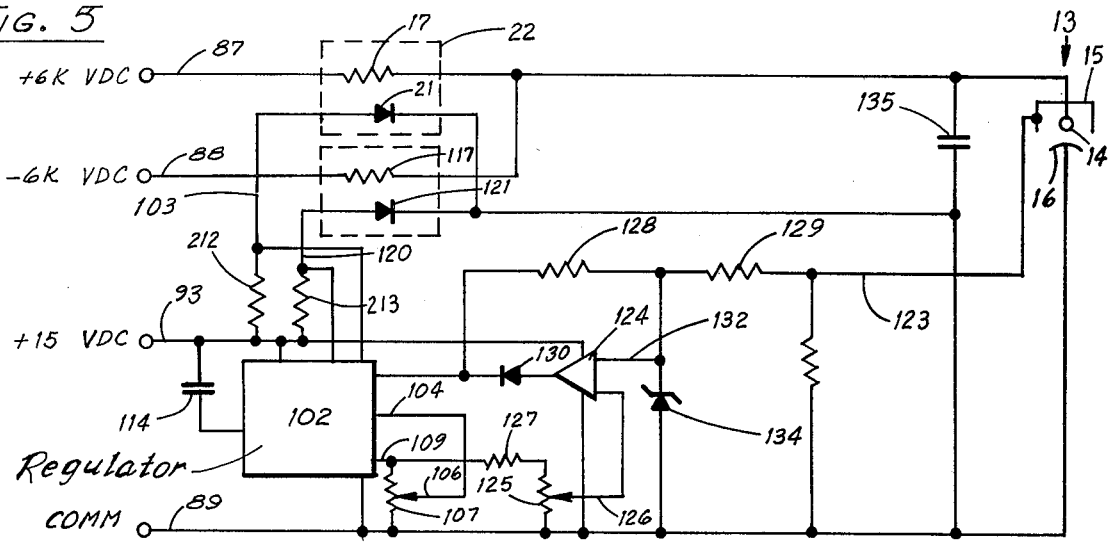
FIG. 6
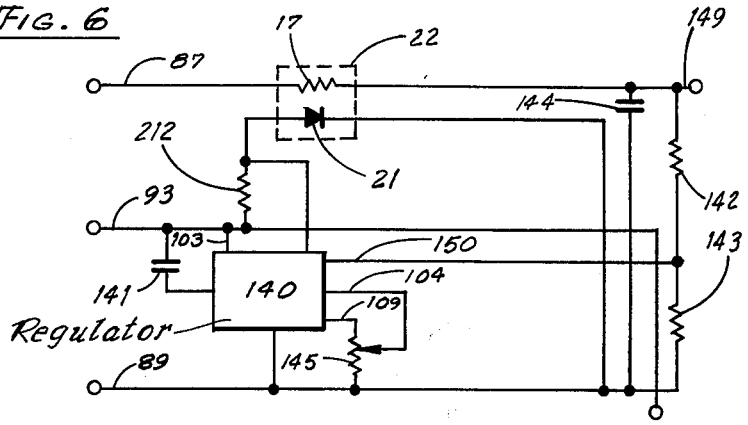
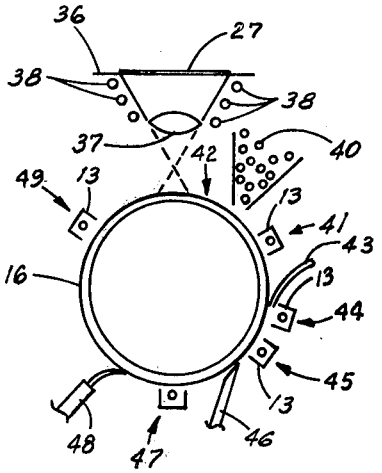
FIG. 10
FIG. 7
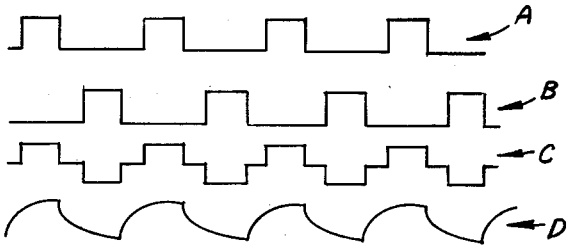
FIG. 8
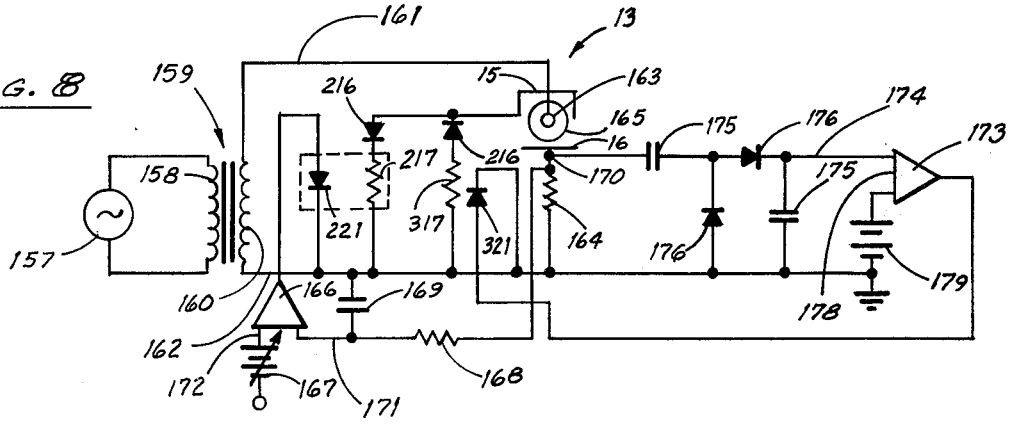

HIGH VOLTAGE REGULATOR USING LIGHT DEPENDENT RESISTOR

FIELD OF THE INVENTION

The invention relates to the regulation of both alternating current and direct current high voltage sources, and has particular application to the regulation of voltage to corotrons in a xerographic reproduction device.

BACKGROUND OF THE INVENTION

Conventional high voltage power systems in which voltage must be controlled employ a high voltage transformer and filter and a shunt regulator. For direct current bias control, a shunt regulator amplifier leads from the load and is connected to the base of a shunt transistor, which shunts a part of the applied power to bypass the high voltage transformer, depending upon the bias at the base of the shunt transistor. Direct current power transmission also requires the use of a rectifier and filter network. In conventional systems an alternative technique which is especially useful in connection with high frequency alternating current high voltage power supplies is a flyback technique in which a high frequency transformer transmits power through a filter network and a flyback rectifier is connected across the load. A regulator transistor is also required at the primary of the high voltage transformer in this arrangement to alter the power to be applied to the primary of the transformer. Power transistors have only a limited application in regulating the output of high voltage power supplies, however. Above two kilovolts regulating transistors are frequently unstable and short lived. The cost and inconvenience of replacement of such high voltage regulating transistors is a significant disadvantage associated with conventional high voltage power supply regulating systems.

An additional disadvantage of conventional high voltage power supply regulating systems is the characteristic feature of regulating either the power input at the primary of a high voltage transformer, or the power output of the secondary of the transformer. In either case a specific amount of power is derived at the secondary output leads and provided to a load. This means that a separate secondary and power regulating or shunt regulating transistor is required for each load to which power is to be supplied. Power transistors can not be connected in series with the electrical loads because they tend to break down rapidly under high voltages of from two to six kilovolts, such as are employed to power corotrons in xerographic reproduction devices. By employing the light dependent resistors in the present invention, which can accommodate such high voltages, an arrangement is provided for separately regulating the power provided to each load through a series connected device. This means that a plurality of such loads may be fed from the secondary of a single high voltage transformer. By employing a feedback circuit to control the series connected light dependent resistor by impressing a desired low voltage signal to an associated light emitting diode, regulation of a plurality of high voltage direct current power supplies to different circuits using a single high voltage transformer can be effectuated. In such an arrangement, power is fed directly from the rectifier-filter on the secondary windings of the power source to the light dependent resistor before reaching the load. Each light dependent resistor can be regulated separately by a separate feedback amplifier and a dedicated light emitting diode.

It is an object of the present invention to provide a stable, durable current regulating device for a high voltage power supply system. The invention has particular applicability to the supply of power to corotrons in xerographic reproducing devices where the power supply exceeds two kilovolts to each corotron and where different corotrons require independent voltage adjustments.

A conventional form of corona discharge device for use in xerographic reproduction systems is shown generally in U.S. Pat. No. 2,836,725 in which a conductive corona electrode in the form of an elongated wire is connected to a corona generating direct current voltage. The wire is partially surrounded by a conductive shield which is usually electrically grounded. The surface to be charged, called a plate, usually takes the form of a rotatable drum and is spaced from the wire on the side opposite the shield and is mounted on a grounded substrate. A corona discharge current flows partially to the plate or drum and partially to the shield. An alternative form of corotron may be biased in a manner taught in U.S. Pat. No. 2,879,395 wherein an alternating current corona generating potential is applied to the conductive wire electrode and a direct current potential is applied to the conductive shield partially surrounding the electrode to regulate the flow of ions from the electrode to the plate. Other biasing arrangements are known in the prior art and will not be discussed in great detail herein.

A further object of the invention is to provide a means by which current flow to the plate of a corotron can be controlled indirectly by directly controlling the current flow between the corotron wire and the corotron shield. Frequently the corotron plate is physically grounded by mechanical means. To directly derive current flow in the plate for use in feedback control would require electrical insulation of the mechanical elements, thus adding to the physical complexity of the corotron device as well as introducing the possibility of electrical malfunction into an area where practically no such possiblity presently exists.

A further object of the invention is to eliminate the requirement for power transistors for power regulation of a high voltage power supply. Power transistors operated at voltages in excess of two kilovolts are often unstable and lack durability, and hence require frequent replacement. The light dependent resistors employed in accordance with the present invention, on the other hand, have a 10 kilovolt rating and can dissipate 20 watts of power. They are not subject to overloading when operated within their rated limits, and hence are much more reliable than are power transistors for high voltage power regulation.

The invention may be explained with greater precision and clarity by reference to the accompanying drawings.

DESCRIPTION OF THE DRAWINGS

FIG. 5 illustrates schematically the details of the control of a high voltage alternating current power supply to corotrons of FIG. 3.

FIG. 6 illustrates schematically the application of the high voltage control to other components of the device of FIG. 3 to achieve a variable voltage direct current output.

FIG. 7 illustrates waveforms produced in the apparatus of FIG. 5.

FIG. 8 illustrates an alternative embodiment of the invention for power regulation in a dicorotron.

FIG. 10 illustrates diagramatically the function of corotrons in a xerographic reproduction device.

DESCRIPTION OF THE EMBODIMENT

Figure 1:
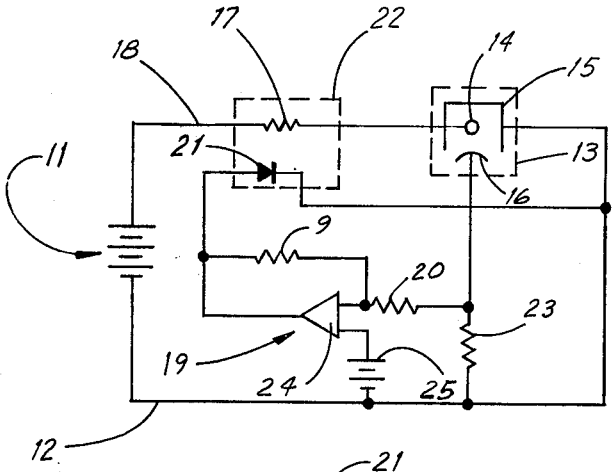
FIG. 1 is a schematic diagram of the invention as applied to a high voltage direct current power supply.

Referring in particular to FIG. 1, a high voltage direct current unregulated power supply is denoted at 11. Although the symbol for a battery is used to indicate the direct current power supply 11, it is to be understood that any source of direct current in excess of two kilovolts, such as a rectifier output for example, may be employed. One lead 12 of the power supply 11 is grounded. The leads 12 and 18 of the power supply 11 are connected to a corotron indicated generally at 13 and including a bare corotron wire 14 extending longitudinally within the confines of a channel shaped corotron shield 15 in electrical isolation therefrom. The corotron 13 also includes a plate 16 which normally assumes the physical configuration of the outer surface of a drum in a xerographic reproduction device.

A light dependent resistor 17 is connected by the ungrounded lead 18 in series with the voltage supply 11 and the corotron wire 14. The light dependent resistor 17 is made of a mixture of cadmium sulfide and cadmium selenide and suitable dopants such as copper chloride which is deposited on an insulating substrate along with two electrical connections. This assembly is sintered at high temperature to form a multicrystal layer of welded crystals. This device has a rated voltage of 10 kilovolts and a power rating of 20 watts. The resistance of the light dependent resistor varies over a very wide range as a function of impinging light. Typical values for a device of one centimeter length and two centimeters width of $10^{11}$ ohms in the dark and $2 \times 10^4$ ohms when suitably illuminated. A feedback circuit 19 is electrically connected to the plate 16 through a current sensing resistor 23. A gallium arsenide light emitting diode 21 is connected in the feedback circuit 19 and arranged within a light tight enclosure 22 in optical Communication with the light dependent resistor 17. While the light emitting diode 21 is referred to in the singular it is to be understood that the term encompasses a preferred embodiment formed of a bank of gallium-arsenide light emitting diodes placed in front of the light dependent resistor 17 so that the light from the diodes evenly illuminates the resistor material. The combination of these two elements is enclosed in a light resistant container 22 to exclude ambient light with the light emitting diode 21 in optical communication with the light dependent resistor 17. As the current through the light emitting diode 21 is increased, the light increases, causing the resistivity of the light dependent resistor 17 to decrease.

With the types of materials mentioned above, the resistivity of the light dependent resistor 17 will change five orders of magnitude in aproximately one-tenth second. This restricts the use of this device with present materials to relatively slow speed applications as far as changing of resistivity is concerned. This does not means, however, that the resistance element cannot be used to control a high frequency AC or pulsed circuit. The element looks like a fixed resistance to these frequencies.

The feedback circuit 19 includes a differential amplifier 24 having one input from the plate 16 and an opposing input from a direct current voltage reference source 25. A feedback resistor divider 9 and 20 is connected from the amplifier output and input to the plate 16.

The primary application of the circuit of the invention is for regulation of voltage or current in a high voltage low current circuit such as that used in the corotrons in a xerographic copier. The corotron 13 is useful in conditioning a cylindrical drum to reproduce printed materials from an original source document onto sheets of paper in a xerographic reproduction device. The high voltage on the wire 14 of the corotron 13 results in an electron flow both from the plate 16 and also from the shield 15 to the corotron wire 14. The plate 16 and shield 15 are electrically connected together and held at essentially ground potential. Thus, a portion of the electrical current transmitted through the lead 18 to the corotron wire 14 flows to the plate 16 and the remaining portion flows to the shield 15.

The circuit of FIG. 1 connects the light dependent resistor 17 as a series dropping element between the high voltage source 11 and a load in the form of the corotron 13. In this circuit, the current flowing from the voltage supply 11 flows through light dependent resistor 17, the corotron 13 and return resistor 23. The voltage across resistor 23 is compared with voltage from the reference voltage source 25 by operational amplifier 24. If the voltage across resistor 23 is less than the reference, amplifier 24 will cause more current to flow through light emitting diode 21, which will in turn cause a reduction in resistance of light dependent resistor 17. With reduced resistance more current will flow from power supply 11 thorugh light dependent resistor 17, and return resistor 23. When the drop across return resistor 23 becomes nearly equal to the reference input from reference source 25, the resistance of light dependent resistor 17 will no longer be decreased and the loop will stabilize. As the voltage across power supply 11 or the voltage drop of the corotron 13 change due to external influences, the value of light dependent resistor 17 will be adjusted by operational amplifier 24 to keep the voltage drop across return resistor 23, and hence the current in the loop constant. Typical values for this circuit might be 6 kilovolts for voltage supply 11, 4 kilovolts across the corotron 13, 1 volt across return resistor 23, and 300 microamperes flowing in the circuit. The load could be other than a corotron 13. For example, the load could be resistive, a CRT, plasma devices, etc.

Figure 2:
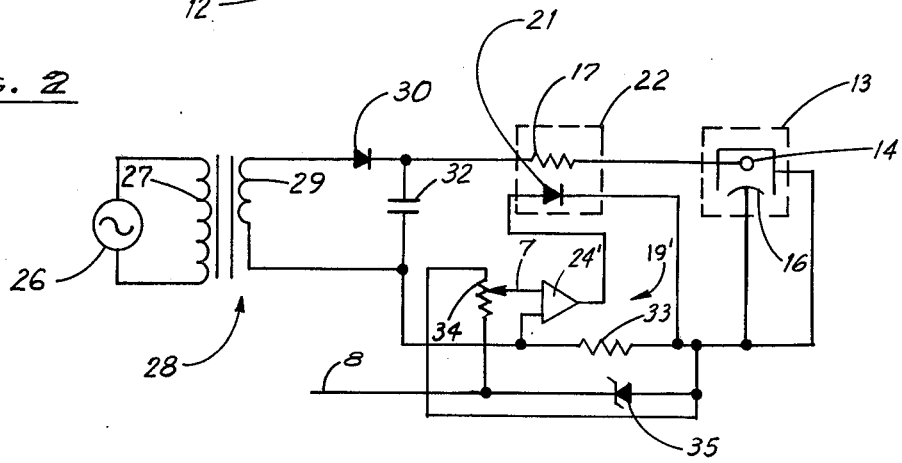
FIG. 2 is a schematic diagram of the invention as employing an alternative feedback technique to that of FIG. 1.

A similar control device is depicted in FIG. 2 An alternating current generator 26 provides high voltage electrical current to the primary winding 27 of a high voltage transformer 28, the secondary of which is indicated at 29. A blocking diode 30 and filtering capacitor 32 form a halfwave rectifier circuit which provides current through the light dependent resistor 17 to the corotron 13. Again, a plate current is induced and a signal is derived from the resistor 33 connected to the return of transformer 28. Instead of a static reference signal, such as the D.C. signal provided at 25 in FIG. 1, however, the operational amplifier 24' of FIG. 2 is connected in a feedback loop 19' to LED 21 through a movable arm 7 of a potentiometer 34. A zener diode 35 is employed to provide a constant voltage to potentiometer 34 from an external supply on line 8. The division ratio of the potentiometer 34 provides a variable level reference voltage. The power supply 26 is preferably a 25 kilohertz oscillator type voltage source connected to the load, which is the corotron 13, through a series connected light dependent resistor 17 so that the current delivered to the corotron 13 is controlled by the LED 21.

In the circuit of FIG. 2, the increase in current flowing from the corotron wire 14 to the plate 16 produces an increased current through the resistor 33 which serves as a sensor of current level. The amplifier 24' thereby decreases its output to the LED 21. The decreased illumination afforded increases the resistance of light dependent resistor 17, thereby decreasing current to the corotron. During a decrease in current through the load 13, on the other hand, corona discharge current level drops off, thereby increasing the output of the operational amplifier 24'. This in turn increases the current to the photoemitter 21, which reduces resistance of the light dependent resistor 17 and increases current flow from the secondary 29 of the circuit to the corotron 13. Thus, a stablized current regulator is provided.

The application of the corotron 13 to a xerographic reproducing device is depicted in FIG. 10. The plate 16 depicted in FIG. 10 is an annular cylindrical drum, the outer surface of which is coated with a photoreceptor, typically a selenium compound. The plate 16 is loated within a cabinet beneath the surface of a transparent glass viewing plate 36 upon which an original source document 27 to be reproduced is positioned in a flat, face down relationship. An optical lens system, indicated at 37, is positioned directly below the viewing plate 36. Longitudinal fluorescent light fixtures 38 are positioned on either side of the optical lens system 37, so as not to interfere with the image of the material printed on the source document 37 to be reproduced.

When the fluorescent fixtures 38 are illuminated, light is reflected from the surface of the source document 27 which faces the viewing plate 36 through the lens system 37 onto the surface of the drum 16. The lens system moves across the document in synchronism with the drum rotation. Thus, an entire two dimensional image of the contents of the downward facing surface of the document 27 to be copied is transmitted in a corresponding mirror image reproduction at an imaging station indicated at 42 to the surface of the drum 16 as the drum 16 slowly rotates clockwise. Prior to reaching the imaging station 42, the area of the drum 16 which is to receive the image passes a charging station 49. At the charging station 49, a corotron 13 connected to a 6,000 volt D.C. power supply is employed to uniformly charge the surface of the drum 16 to a level of 700 volts. Thus, the charged area of the drum 16 is then ready to receive an optical image of the original source document 27. At the imaging station 42, receipt of the image causes localized discharges on the drum 16 corresponding to the contrasting areas on the document 27. Whether specific locations on the surface of the drum 16 are discharged or not depends upon whether a light or dark area of the document 27 was reflected onto the drum suface. Dark areas, cause no discharge and normally result from printed material appearing on the source document 27, while light areas cause localized discharges and correspond to areas other than the print character areas on the document.

Once the drum has rotated clockwise from the imaging station 42, it passes a longitudinally extending funnel 40 that allows toner comprised of carbon particles to fall onto the drum 16. At each location at which the drum 16 is discharged by the receipt of reflected light, the toner particles do not adhere to the drum, but instead glance off the surface of the drum and fall into a tray for recycling. At those locations where light is not received, and hence the drum is not locally discharged, the carbon particles are attracted and stick to the drum.

The drum continues its clockwise rotation so that the photosensitive area passes beneath a longitudinally extending corotron 13 at a pretransfer station 41. At the pretransfer station 41, the charge on the drum is scaled to produce a zero voltage level at those locations on the drum surface which received light through the lens system 37. That is, at the imaging station 42, the light sensitive areas are discharged from a 700 volt level to a 200 volt level where light impinges locally. Those local areas not receiving reflected light remain at the 700 volt level. To produce a zero voltage level at those areas on the drum corresponding to positions at which light was received, the corotron 13 at the pretransfer station 14 sets up an electrostatic field to reduce the charge at the charged locations from 700 to 500 volts and to reduce the charge at the relatively lower or discharged locations from 200 volts to a zero voltage level.

The corotron 13 at the pretransfer station 41 receives a high voltage alternating current power supply that cycles the voltage potential of the corotron wire 14 relative to the drum 16 at from plus 6000 to minus 5600 volts at a frequency of 400 hertz. This voltage is regulated by the control circuitry of the invention, as will hereinafter be described.

As the drum 16 continues in its clockwise rotation, a sheet of paper, indicated at 43, is fed into contact with the drum 16. Because of the charge at some areas on the drum 16, the paper 43 tightly adheres to the drum once contact therewith is established. Continued clockwise rotation brings the paper 43 and charged areas of the drum 16 beneath another longitudinally extending corotron 13 at a transfer station 44. At the transfer station 44, the corotron wire is provided with a positive 6,000 volt D.C. supply which creates a higher charge on the paper than on the area of the drum 16 adjacent thereto. Thus, the toner particles transfer their adherence from the drum 16, and instead adhere to the paper 43.

As the drum 16 proceeds in clockwise rotation it arrives at another corotron 13 located at the detack station 45 where the corotron 13 is maintained at a positive voltage potential relative to the drum 16. At the detack station 45, however, it is desirable for the corotron voltage level to be varied as the paper 43 with toner adhering thereto proceeds past. The reason for the requirement for variable voltage control at the detack station 45 is because a different charge is required to cause the leading edge of the paper to cease adhering to the drum 16 than is required to cause the interior portions of the paper 43 to be released from the drum 16. Separation of the paper 43 from the drum 16 at the detack station 45 is facilitated by the blade 46, the edge of which is positioned closely adjacent to the drum 16. The blade 46 tends to act as a wedge to separate the paper 43 from the drum 16 at this point in the rotation of the drum. The paper 43 with toner adhering thereto is then transferred to a chemical or heat treatment station, where the toner becomes permanently imprinted on the paper 43. The paper is then passed to a static eliminator, hereinafter to be described, and then to a copy bin where it may be removed from the xerographic reproduction device at the convenience of the machine operator.

The drum 16 continues its automatic clockwise rotation until the area thereof at which printing is effectuated reaches a precleaning station 47 where another corotron 13 is located. The corotron 13 at the precleaning station 47 is provided with an alternating current power supply varying between plus and minus 6,000 volts at 400 hertz. It is the function of the corotron at the precleaning station 47 to neutralize the charge at locations on the drum 16 as the drum rotates.

A rubber squeegee 48 positioned further clockwise from the precleaning station 47 serves to scrape toner particles that may, for any reason, continue to adhere to the drum 16. Cleaned and with a neutral charge, the drum 16 continues to rotate clockwise until it again reaches the charging station 49, whereupon the printing process is repeated.

The xerographic image reproduction device depicted in FIG. 10 is merely representative of a number of different modified forms of such devices which may be employed to effectuate the reproduction of images of source documents onto sheets of paper. Such image reproduction devices employ anywhere from four to seven corotrons, depending upon the particular features of the reproduction device and upon the requirements of the apparatus utilized.

Figures 3, 9:
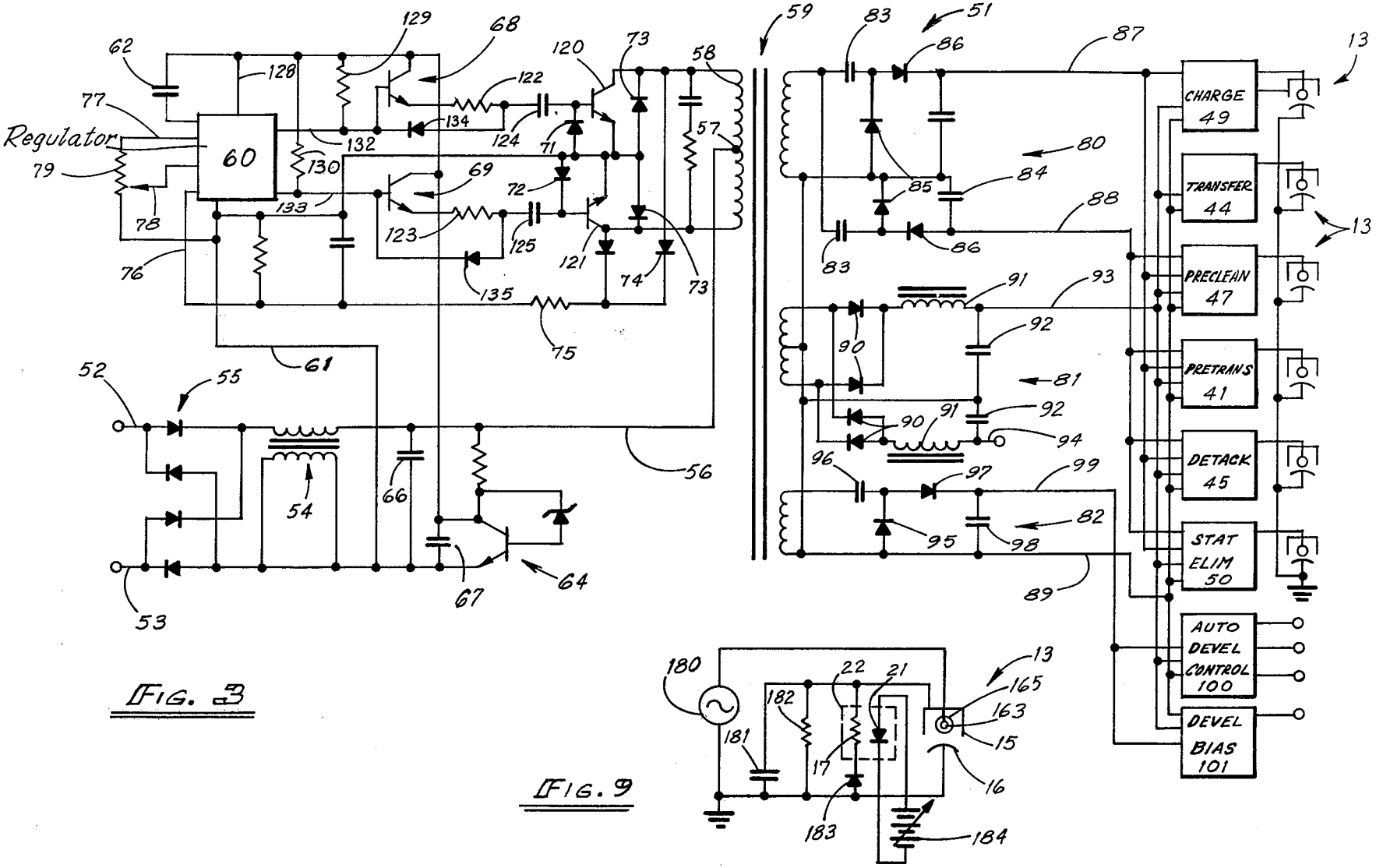
FIG. 3 illustrates the parallel connection of corotrons across a single high voltage transformer in a xerographic reproduction device utilizing the controls of the invention.
FIG. 9 illustrates a simplified control of a dicorotron.

The electrical high voltage power supply apparatus for the xerographic reproduction device of FIG. 10 is depicted in detail in FIGS. 3 through 7. FIG. 3 depicts the basic power derivation circuitry for the entire system and the interconnection of that circuitry to the various corotron control circuits denoted by reference numerals corresponding to the stations of the xerographic reproduction device which they serve. In addition to those corotron stations noted in connection with FIG. 10, a static eliminator station 50 is also provided. The static eliminator station 50 employs a very rudimentary corotron 13, the voltage control of which is not particularly critical. The static eliminator station 50 is physically located near the discharge port of the xerographic reproduction device and serves to eliminate static from the sheets of paper following the heat or chemical treatment necessary to cause the toner to adhere to the paper. The static eliminator station 50 is provided with the same alternating current supply that is used to power the detack station 45, the pretransfer station 41, and the precleaning station 47. The corotron utilized at the static eliminator station 50 is not a wire, but rather is a bar along which electrodes connected electrically and in parallel are longitudinally spaced.

The input rectifier and main regulator control circuity are depicted in FIG. 3. 120 volt, 60 cycle alternating line current is received at terminals 52 and 53. This alternating current is passed through a filter choke 54 to which rectifiers 55 are connected. The rectified output current is passed on lead 56 to the center tap 57 between the two halves of the primary 58 of a high voltage transformer 59. The return path for current through the primary halves is through the power transisters 120 and 121. Diodes 73 are connected between the emitter and collector of each of the power transistors. Diodes 71 and 72 at the base-emitter connections of transistors 120 and 121 respectively are clamping diodes to limit the voltages to which the bases of the power transistors can be dropped.

Power will be conducted through the primary 58 of the transformer 59 provided that one of the power transistors 120 and 121 is on. Power transistors 120 and 121 are controlled by driver transistors 68 and 69 respectively. The driver transistors 68 and 69 act through the resistors 122 and 123 and capacitors 124 and 125 to forward bias the bases of the power transistors 120 and 121 when the driver transistors 68 and 69 conduct. Operation of the driver transistors 68 and 69 is controlled by a programmable regulator 60. The regulator 60 internally generates a pulse train which periodically removes a positive bias from the output leads 132 and 133. Between pulses generated within the programmable regulator 60, a positive bias is provided from the lead 128 which acts through the resistors 129 and 130 to forward bias the driver transistors 68 and 69. However, during the existance of an internally generated pulse within the regulator 60, power is removed alternately from the leads 132 and 133 which are connected to the common ground 61 through the regulator 60. This causes the capacitors 124 and 125 to discharge through the diodes 134 and 135, thus removing the forward bias from the bases of the power transistors 120 and 121 alternately. When the power transistors 120 and 121 no longer conduct, current conduction through half of the primary 58 of the high voltage transformer 59 is abruptly terminated, and no further power is transmitted until termination of the internally generated pulse within the regulator 60. The frequency of internal pulse generation within regulator 60 is determined by the rating of the capacitor 62 and the duration of each pulse generated is determined by adjustment of the wiper 78 along the potentiometer 79, the output of which is fed back to the regulator 60. By adjustment of wiper 78 the internal pulse width generated by regulator 60 will be altered and transistors 68 and 69 will be turned on for a greater or lesser duration of the cycle frequency established by the capacitor 62. This adjustment in turn controls the amount of power transmitted by the transformer 59.

A plurality of secondary windings 80, 81 and 82 are provided for the single primary of the high voltage transformer 59. Coupling capacitors 83, filtering capacitors 84 and rectifiers 85 and 86 in conjunction with the secondary 80 of the transformer 59 provide a constant D.C. voltage level of plus 6,000 volts on the lead 87 and minus 6,000 volts on the lead 88. The plus 6,000 voltage level is transmitted to all of the corotrons at each of the charge stations, but the minus 6,000 volt supply from the lead 88 is provided to only those corotron stations which are to receive an alternating current power supply. A common grounded connection 89 serves all of the corotron stations as indicated.

The secondary 81 of the high voltage power transformer 59 includes rectifiers 90 that rectify the transformer secondary winding output, an inductor 91 and a smoothing capacitor 92 to produce a positive 15 volt supply on lead 93. This low voltage current supply on the lead 93 is transmitted as a regulator power supply to all of the corotron stations that are utilized for control purposes. Similarly, rectifiers 90 connected in opposite polarity, a capacitor 92, and another inductor 91 culminate in a negative 15 volt D.C. supply at 94.

The transformer secondary 82 includes an A.C. blocking capacitor 96, rectifiers 95, 97, and a filtering capacitor 98 to provide a 600 volt D.C. power supply on lead 99. This 600 volt supply is transmitted to an automatic development control circuit 100 and to a developer bias circuit 101. The automatic developer control circuit 100 and developer bias circuit 101 do not terminate in corotrons, but instead are used to develop and control power supplies for various other internal functions in the xerographic reproduction device.

Figure 4:
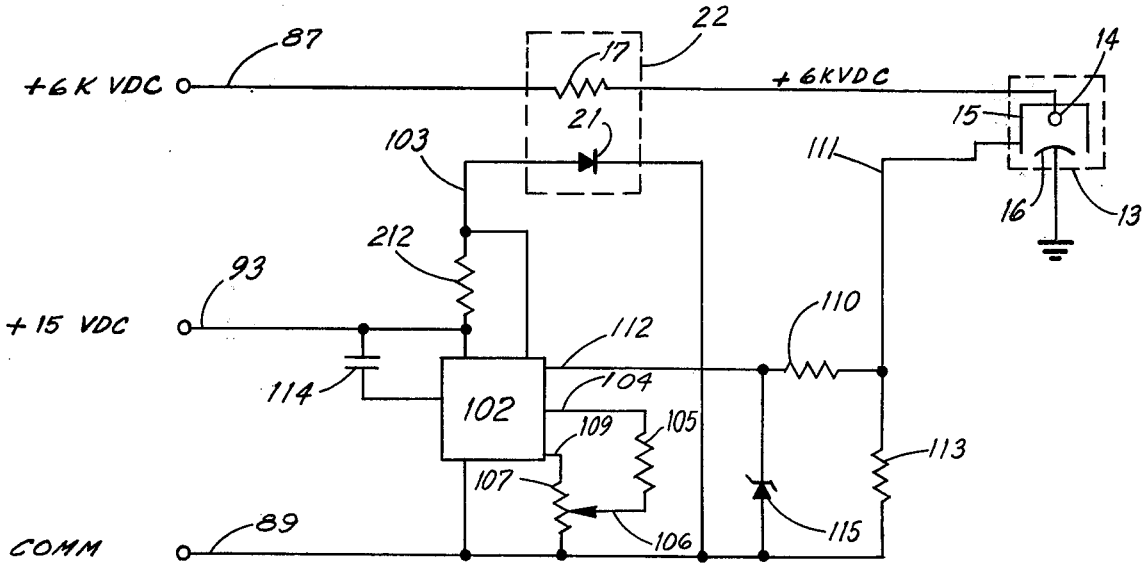
FIG. 4 illustrates schematically the details of the control of a high voltage direct current power supply to corotrons of FIG. 3.

The high voltage direct current regulating circuit employed at the charging station 49 and the transfer station 44 is depicted in FIG. 4. At each of these stations 44 and 49, the 6,000 volt D.C. supply on lead 87 is transmitted to a light dependent resistor 17 which is connected in series to the corotron wire 14 of a corotron 13. The shield 15 of the corotron 13 is connected to the common or ground 89 through a resistor 113 while the plate 16 is grounded directly as indicated.

The regulator circuit power supply 93 of 15 volts D.C. developed in the transformer secondary 81 is connected to the power supply input of a feedback regulator 102. The feedback regulator 102, generates two pulse trains. One of these pulse trains is of variable width and is produced on the output 103 which is carried through a dropping resistor 212 and is transmitted to a light emitting diode 21 to effectuate control of the light dependent resistor 17. Light emitting diode 21 and light dependant resistor 17 are housed together in optical communication within a light tight enclosure 22. The other output of the feedback regulator is a reference output at 109 which is passed through the wiper arm 106 of a potentiometer 107, through a resistor 105, and back to regulator 102 as a reference voltage at 104. The reference voltage of the output at 109 may be altered by adjustment of the wiper arm 106 of potentiometer 107. The pulse width at the output 103 is controlled to track the voltage of the reference output 104, so that if the voltage of the output 104 is increased, the pulse width of the output 103 will likewise be increased which will illuminate the resistor 17 for a greater length of time. This will decrease the resistance of the light dependent resistor 17, and hence increase the current flowing from the corotron wire 14 to the plate 16. Conversely, a decrease in the pulse width of the output 103 will result in less illumination of the light dependent resistor 17, and hence less current from the corotron wire 14 to the plate 16. Light dependent resistor 17 is slow to respond to changes in illumination so that it does not exhibit a pulsating effect with the pulse trains appearing at 103, as does the light emitting diode 21.

Control is effectuated to the feedback regulator 102 by reference input 104 which feeds one side of a differential amplifier within the regulator 102. This input is derived from an output 109 which carries a reference voltage established by adjustment of the wiper 106 of potentiometer 107. The other side of the differential amplifier is connected to shield 15 by lead 111 connected to a resistor 110 and to an amplifier input 112. A zener diode 115 serves as a ground clamp to limit the voltage or lead 112 with respect to absolute ground of the plate 16.

In operation, the rated value of the capacitor 114 connected at the input to the feedback regulator 102 determines the frequency of the signal to be impressed upon the light emitting diode 21, and the pulse width of the pulse train at 103 determines the periodic duration of current to LED 21. The reference voltage is used to increase or decrease the duration of a signal at output 103 of the regulator 102. Any increase in current flowing on lead 111 from the shield 15 will be transmitted to the opposing input lead of the differential amplifier at 112. Such an increase in shield current is merely indicative of an overall current increase to the corotron 13, and also reflects an increase in current flow from the corotron wire 14 to the plate 16. Therefore, if the shield current 15 increases above a predetermined level, this is indicative that the plate current has likewise increased above its predetermined level. The differential amplifier receiving the inputs from 104 and 112 recognizes the increased differential of the input at 112 over the reference input at 104 and accordingly decreases the width of the pulse output on lead 103 to light emitting diode 21. The decreased pulse width reduces the duration of the time of a cycle during which light emitting diode 21 illuminates light dependent resistor 17. This increases the resistance of light dependent resistor 17, which is slow to respond to changes in illumination, and hence does not exhibit a pulsating effect in response to the pulsating illumination of light emitting diode 21. Nevertheless, light dependent resistor 17 does respond to changes in the relative portion of a frequency cycle during which light emitting diode 21 is illuminated, and increases resistance in response to decreases in proportionate duration and decreases resistance in proportion to increases in portionate illumination.

The reason that the current between the corotron wire 14 and the shield 15 is used as an index of current from the corotron wire 14 to the plate 16 is due to the physical difficulty of interposing the feedback circuitry between the corotron plate or drum 16 and ground. Also, the separate control circuitry depicted in FIG. 4 is more easily associated with the several different corotron shields 15 instead of the single rotating corotron drum or plate 16.

The high voltage alternating current regulation circuit associated with the detack station 45, the pretransfer station 41, and the precleaning station 47 is depicted in detail in FIG. 5. The regulator feedback circuitry of FIG. 5 processes the direct current high voltage power of opposing polarity provided at lines 87 and 88 and operates in much the same manner and contains many of the same elements as the high voltage direct current regulator circuitry of FIG. 4. Specifically, the same type of regulator 102 is employed in which a capacitor 114 regulates the frequency of pulse train cycles. Regulator 102 is connected to the 15 volt regulator circuit power supply line 93. The waveform product at line 103 is shown at A in FIG. 7 and the waveform produced at line 120 is shown at B in FIG. 7. Thus, illumination of the LED 21 associated with the light dependent resistor 17 connected in series with the positive 6,000 volt D.C. supply line 87 and with the corotron wire 14 occurs for one half of the cycle frequency established by the capacitor 114 for the pulse outputs of the regulator 102. Similarly, the light emitting diode 121 is illuminated for one half of the total cycle time during the opposite half cycle of the pulse output on line 120 from the regulator circuit 102. As a practical matter, illumination of each of the LED's 21 and 121 will be considerably less than one half of the frequency cycle, and the exact duration of illumination of each will be dependent upon the differential amplifier output from the regulator 102.

As with the direct current regulator circuit, of FIG. 4, a lead 109 from a potentiometer 107 having an adjustable wiper 106 is connected to an input of a differential amplifier within the regulator circuit 102. The current between the corotron wire 14 and the shield 15 is not connected directly to the control circuit 102, but rather is connected as one input to a full wave rectifier 124. The other input to full wave rectifier 124 is derived by the adjustment of a wiper 126 of a potentiometer 125 connected to a resistor 127 and to the reference lead 109. The output from the full wave rectifier 124 is thus a D.C. level which is a function of the A.C. amplitude at point 123 and the D.C. reference voltage on line 126.

Resistors 128 and 129 acts as a voltage dividing network and are provided to set the amplification of rectifier 124. The zener diode 134 is provided from the common ground 89 to protect the full wave rectifier 124 from damage due to arcing in corotron 13.

In the operation of the circuit of FIG. 5, a pulse train shown at A in FIG. 7 on lead 103 serves to illuminate the LED 21 for a portion of the half cycle established by the capacitor 114. This portion is modified by the output of the full wave rectifier 124. If the differential between the reference D.C. level from the wiper 107 and the shield current rises, the duration of the pulses appearing at the lead 103 increases, thereby increasing the time of illumination of the LED 21 thus decreasing the resistance of the light dependent resistor 17. On alternative half cycles, the width of pulses appearing on the lead 120 similarly controls the resistance level of the light dependent resistor 117. A capacitor 135 at the output of the two light dependent resistors 17 and 117 smooths the 400 hertz frequency cycle shown in FIG. 7 at C to the wave shape of FIG. 7 depicted at D generated by the regulator circuit 102. This wave shape appears in the current at the corotron wire 14 and flowing to the shield 15 and plate 16.

When current drops, it proportionately drops both with regard to current flow to the shield 15 and to the plate 16. By treating the current flow to the shield 15 as an index, a drop in current from the wire 14 to the plate 16 is reflected as a drop in output level of the differential amplifier 124. This in turn increases the width of the pulses appearing on the leads 103 and 120 thus increasing the duration of illumination of the LED's 21 and 121. An increase in illumination lowers the resistance levels of the light dependent resistors 17 and 117, thereby raising the current flow in the lines 87 and 88 to the wire 14. A high voltage alternating current control system is provided for stabilizing the current flow from the corotron wire 14 to the shield 15, and also from the wire 14 to the plate 16.

The high voltage current regulation system of the invention is not limited to use with corotrons 13. For example, the circuitry of FIG. 6 illustrates the application of the same principals of operation to a high voltage system, the output of which is employed to put a charge on the toner in a xerographic reproduction device. The circuitry of FIG. 6 is utilized as the automatic developer control 100 which is indicated in FIG. 3. The control system of FIG. 6 receives the same regulator power supply 93, the same high voltage D.C. power output 87 and employs the same common ground 89 as do the various corotrons 13. A light dependent resistor 17 and an optically associated light emitting diode 21 are employed in a light tight chamber 22 as in the other embodiments of the invention to produce a regulated power output at 149. The output at 149 appears as a D.C. level variable between 100 and 400 volts smoothed by interconnection of the capacitor 144 between the output D.C. line 149 and the common ground 89. The regulator 140 functions in the same manner as does the regulator 102 in FIG. 4. The other input to the internal differential amplifier appears at the lead 150 which is connected to the voltage dividing network formed by the resistors 142 and 143.

As with the other voltage controlled systems, when the output at the lead 149 decreases, a reduced voltage will appear at the input 150 to the internal differential amplifier. This reduces the output thereof which in turn increases the width of pulses appearing on the variable pulse output 103. The result is an increased illumination time of the light emitting diode 21 which results in a decreased resistance of the light dependent resistor 17. Conversely, when the output at lead 149 rises, the differential amplifier input 150 also rises thus decreasing width of the pulses on variable pulse output lead 103 to produce increased resistance in light dependent resistor 17 and a reduced voltage at lead 149.

A further arrangement of the invention is depicted in FIG. 8. An alternating current source 157 acts across the primary 158 of a high voltage transformer 159. The secondary 160 of the high voltage transformer 159 is connected to leads 161 and 162, which are respectively connected to a dicorotron wire 163 and to a plate 16 through resistor 164. The dicorotron wire 163, unlike the corotron wire 14, is coated with a dielectric substance 165 such as glass so that it conducts only alternating current. This glass prevents the flow of direct current from the wire 163 to either the shield 15 or drum 16, therefore requiring an alternating current source usually about 4 kilohertz. In effect, therefore, the dicorotron wire 163 with dielectric coating 165 acts as a capacitor in the system. The control system of FIG. 8 employs a direct current reference controlling amplifier 166 which has an adjustable direct current reference input 167 on one lead and which receives the input from a voltage tap at 170 on the plate side of the resistor 164 through an integrating resistor 168 at its other input lead. A capacitor 169 connected to ground filters the A.C. component from the signal appearing at the tap 170 adjacent to the plate 16. Thus, the entire input on lead 171, like the input on lead 172 to the differential amplifier, is a direct current input.

The output of the differential amplifier 166 is a direct current level which powers a light emitting diode 221. The LED 221 in turn is optically coupled to the variable light dependent resistor 217, which has a range of 0.2 to 400 megohms. Thus, the feedback circuit depicted is formed by the tap at 170, the differential amplifier 166, the D.C. reference voltage 167 and the LED 221. The LED 221 in turn is optically coupled to the variable light dependent resistor 217, which has a range of 0.2 to 400 megohms. The feedback circuit depicted provides a control to maintain the D.C. component of voltage on resistor 164 at the target level.

In addition to governing the direct current voltage, another differential amplifier 173 is provided and receives an input at 174 from the voltage tap at 170 through a series connected capacitor 175. Two rectifiers 176 are connected with capacitors 175 to provide a peak to peak voltage detection arrangement. Thus, the signals appearing on input 174 are always of a positive polarity. The capacitors 175 are of sufficient size to transform the alternating current passing from the dicorotron wire 163 to the plate 16 to a direct current voltage level. This allows the input at 174 to be compared with the input at 178 that is connected to a direct current voltage source 179 which is adjustable to be indicative of a desired alternating current reference level. The output of the differential amplifier 173 is passed to another light emitting diode 321, which is connected in optical communication with a light dependent resistor 317. The resulting control circuity superimposes control of the alternating current component onto a control of direct current bias.

In the circuit of FIG. 8 a target D.C. voltage bias level is established and regulated. During the cycle of operation of the dicorotron, current is conducted from the dicorotron wire 163 to either the plate 16 or to the shield 15 in a predetermined ratio. D.C. bias level regulation is achieved by controlling the level of current flowing from the dicorotron wire 163 to the shield 15. During the negative half cycles of voltage, current flows through the rectifier 216 and the light dependent resistor 217 as well as through the resistor 164. If the corona discharge current is too great, it will be excessively large both from the coated dicorotron wire 163 to the shield 15 and from the wire 163 to the plate 16. This will produce an increased voltage drop across the resistor 164 and will raise the potential at the point 170 adjacent to the plate 16. An increase in potential at point 170 will increase the input on lead 171 to the differential amplifier 166, thereby increasing the output of the differential amplifier 166. This in turn increases the illuminating effect of the light emitting diode 221 thereby lowering the resistance of light dependent resistor 217. A decrease in this resistance increases current during the positive half cycles through the shield 15 and decreases positive current through the plate 16.

In addition, an increase in the A.C. component of the current will likewise produce an increase on the lead 174 from the peak to peak voltage detecting connections. The output of differential amplifier 173 will therefore increase the illuminating effect of light emitting diode 321 which is in optical communication with the light dependent resistor 317. The resulting decrease in resistance of the resistor 317 decreases the overall parallel resistance. The high voltage direct current bias is subjected to control with respect to the D.C. reference voltage source 167, and the alternating current high voltage current flow is referenced, in effect, with respect to the D.C. reference voltage 179.

The circuit of FIG. 8 allows the direct current bias to be controlled by the ratio of the resistances of resistors 217 and 317, but the parallel resistance of these two resistors is used to control the alternating current level through the shield 15, thus causing a change of voltage differential across the dielectric coating 165 on the corotron wire 163. This change of capacitive voltage causes a change of corotron wire voltage which in turn causes a change in the alternating current flow between the corotron wire 163 and plate 16. The capacitive effect may be provided by any form of impedence, such as series capacitors, series capacitors and resistors, and series capacitors and an inductor. There must be some form of series connected capacitor in order to generate the direct current bias component, however.

The resistors 217 and 317 can also be formed of other types of variable impedences, either passive or active, such as transistors. The control circuit of FIG. 8 can be linear or pulse width controlled. If one of the resistors 217 or 317 is controlled by an amplifier sensing the alternating current component, and the other resistor is controlled by an amplifier sensing the direct current bias both can be adjusted and regulated.

A further embodiment of the invention is depicted in FIG. 9, which illustrates a simple but effective power regulator control as applied to a dicorotron. As in the embodiment of FIG. 8, an alternating current source is provided, and is indicated at 180. A dicorotron 13 has a coronode wire 163 coated with a dielectric 165, as well as a shield 15 and a plate 16 as used in a xerographic image reproduction device. The alternating current source 180 is a high voltage alternating current and is impressed on the dicorotron 13 across the plate 16 and the wire 163. Several parallel electrical connections also exist between the plate 16 and the shield 15. In one connection a light dependent resistor 17 is coupled in series with a current rectifying diode 183. Likewise, a filtering capacitor 181 and a biasing resistor 182 are connected in separate parallel circuits. The regulator circuit also includes an LED 21 which is located in optical communication with the light dependent resistor 17 in a light tight enclosure 22. The input to the LED 21 is an adjustable current from D.C. source 184. LED 21 controls the degree of illumination of the light dependent resistor 17 and thereby controls the resistance of the light dependent resistor 17. The regulator circuit thus serves to produce a predetermined bias between the shield 15 and the plate 16 causing a greater or lesser portion of the current to be shunted past the resistor 182 on one half cycle depending upon the resistance value of the light dependent resistor 17.

Figure 11:
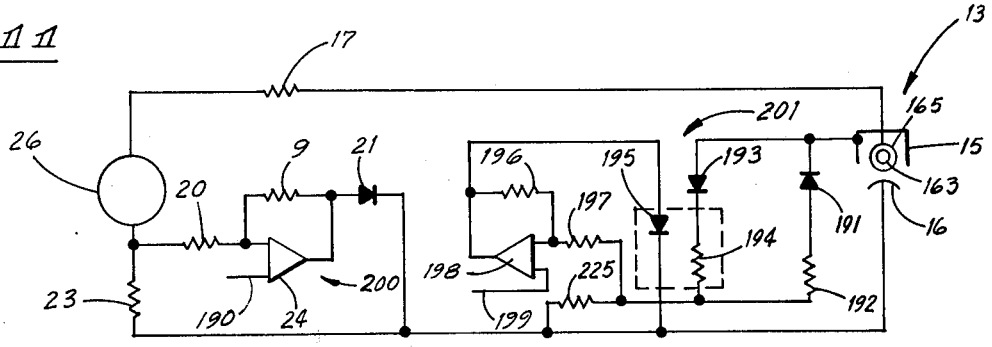
FIGS. 11 and 12 show embodiments of the invention with dual regulators.

Further embodiments of the invention are depicted in FIGS. 11 through 15. FIG. 11 shows two regulators 200 and 201, used with a dicorotron 13. The glass coating 165 of the dicorotron prevents the flow of direct current from the wire 163 to either the shield 15 or the drum 16, thereby requiring an alternating current source 26. This source is usually about 4 kilohertz. The regulating circuit 200 is formed using a reference voltage source 190 acting through a differential amplifier 24 and utilizing a light dependent resistor 17 and light emitting diode 21 substantially in the manner described in connection with FIG. 1. The regulator 200 regulates the alternating current flow to the dicrotron 13. In FIG. 11 the return path for the shield 15 is also controlled to develop direct current in the dicrotron 13. The diodes 191 and 193 are connected in series respectively with a stable resistor 192 and a light dependent resistor 194. If the resistive values of the resistors 192 and 194 are unequal, a different amount of current will flow the positive half cycle produced by the alternating current voltage source 26 than in the negative half cycle. If the resistance of the light dependent resistor 194 is less than the fixed resistance 192, the net current flow over a full cycle is from the wire 163 through the shield 15 to ground. Because no direct current can flow through the glass coating 165 on the wire 163, a net current flow equal to the shield current must exist from the drum 16 to the coronode wire 163.

In the circuit of FIG. 11, the resistor 225 is used to sample the direct current component of shield current and produce a voltage which can be compared with the reference voltage 199 to differential amplifier 198. If the direct current component is less positive than the reference voltage 199, the amplifier 198 will cause more current to flow through the light emitting diode 195, thus causing the resistor 194 to be reduced in resistive value. This increases the direct current component. A signal regulating resistor 197 and a feedback resistor 196 stablize the signal supplied to the amplifier 198.

As the input voltage or the impedence of the dicrotron 13 changes due to external influences, the light dependent resistor 17 will change to keep the alternating current constant. Similarly, the light dependent resistor 194 will change to keep the direct current component constant with changes of dicorotron impedence. If the value of resistance of the resistor 192 is fixed and the resistance value of the light dependent resistor 194 is varied from a value higher than that of resistor 192 to a value lower than that of the resistor 192, the direct current component will vary from negative to positive. The regulator 201 can be set to either a positive or negative value, and will therefore hold any value, either positive or negative to match the reference voltage 199. Because the direct current component between the wire 163 and the shield 15 is always equal and opposite in polarity to the direct current component between the wire 163 and the drum 16, regulation of the shield current also holds the drum current constant.

Figure 12:
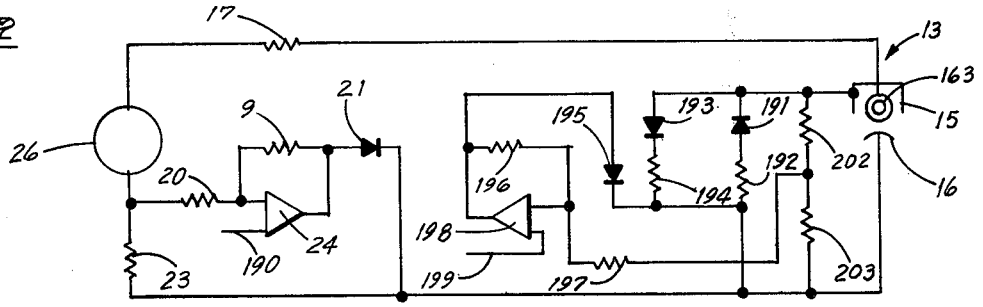

The embodiment of FIG. 12 is very similar to that of FIG. 11 with the exception that it operates to maintain a constant direct current voltage on the shield 15. In the embodiment of FIG. 12, the voltage divider formed by the resistances 202 and 203 provides a sample of voltage to the amplifier 198. With the circuit of FIG. 12, as well as that of FIG. 11, as the resistance of light dependent resistor 194 is varied, the effective full cycle impedence of one-half the sum of the resistances of resistors 192 and 194 is changed. This impedence change causes a change in the ratio of alternating current through the shield 15 to the alternating current through the drum 16. If more than one dicrotron 13 is to be operated from the same alternating current power source 26, it is no longer possible to sample the current in the power supply return. However, if the circuit is changed to that of FIG. 13, the alternating current can be sampled in the resistor 226 because as the resistance of the light dependent resistor 194 is lowered, the resistance of the light dependent resistor 204 is raised. The direct current is a function of the ratio of the resistances of the two light dependent resistors 194 and 204. Therefore, the effective full cycle impedence can be held constant while the ratio is changed from a small fraction to a large number, thus giving full control from a negative maximum to a positive maximum.

Figure 13:
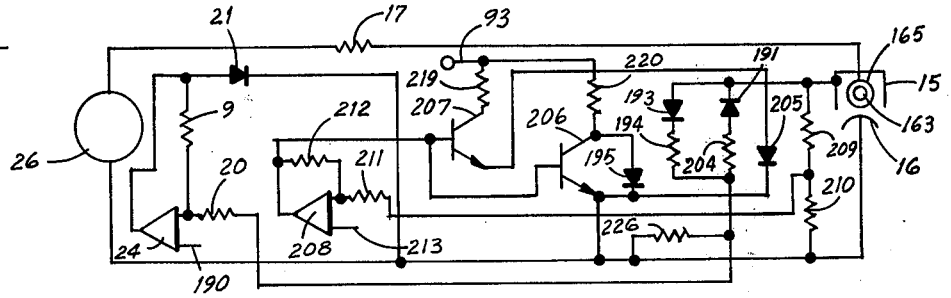
FIGS. 13, 14 and 15 show embodiments of the invention with dual light dependent resistors.

In the circuit of FIG. 13, the current through the light dependent resistor 194 and 204 is controlled respectively by the light emitting diodes 195 and 205. The outputs of the diodes 195 and 205 are coupled together to the emitter of transistor 206. The input of diode 195 is connected to the collector of transistor 206 while the input of diode 205 is connected to the emitter of transistor 207. The collectors of transistors 206 and 207 are coupled together through resistors 219 and 220. These transistors are powered by the low voltage power supply line 93. The transistors 206 and 207 receive forward biasing voltage at their bases from the regulating amplifier 208. Amplifier 208 receives one input from a tap to the voltage divider formed by the resistances 209 and 210 through a resistor 211. A feedback resistor 212 is coupled from the output of the amplifier 208 to the amplifier input from the voltage divider. The other input to the amplifier 208 is a reference input 213.

With the shield return impedence through the resistors 194 and 204 held nearly constant, the ratio of shield alternating current to drum alternating current will remain nearly constant. This permits the use of the shield return alternating current as a representative indicator of the drum alternating current. The regulator formed by the amplifier 24, the light emitting diode 21 and the light dependent resistor 17 will hold the shield return alternating current constant, thereby giving good stability to the drum alternating current.

Figure 14:
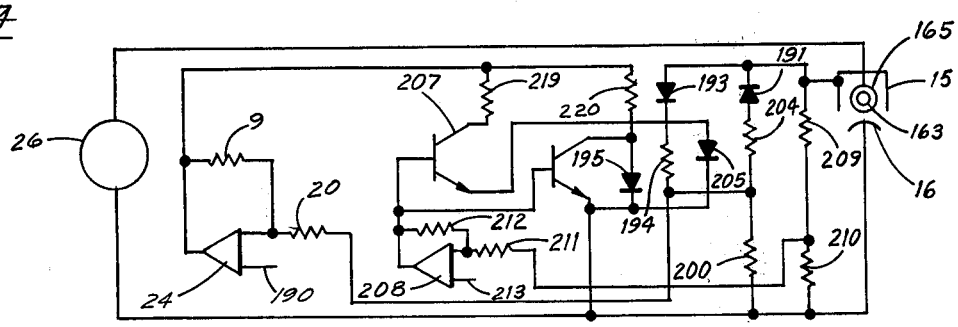

A modification of the concept of FIG. 13 is shown in FIG. 14. In this circuit, instead of using a light dependent resistor in the coronode circuit to control the alternating current, the differential amplifier 24 controls the total current to the light emitting diodes 195 and 205 so that the effective full cycle impedence of the light dependent resistors 194 and 204 can be controlled. By varying this full cycle impedance, the average current in the shield can be varied. The shield current represents about one-half of the total coronode current. Therefore, as this shield current is varied the voltage drop across the capacitive reactance caused by the glass coating 165 on the corona wire 163 can be varied, thus effectuating a change in current to the drum 16. This circuit gives some degree of regulation of drum current, but is limited by the fact that the shield circuit impedence varies while the shield current is sampled to control the impedence. This varying impedence represents a change in ratio between the current through the shield 15 and through the drum 16.

Figure 15:
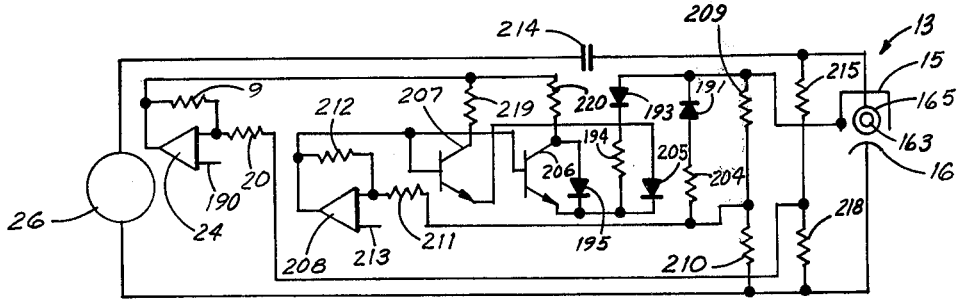

FIG. 15 shows a modification of the circuit of FIG. 14 which can be used if the drum alternating current regulation of FIG. 14 is not sufficient. In FIG. 15, an additional capacitor 214 is placed in the corona circuit. Also, a voltage divider formed from resistors 215 and 218 samples the alternating current coronode voltage. This sample through the amplifier 24 controls the average alternating current in the shield, thus providing a variable voltage drop across the series capacitor 214. With the circuit of FIG. 15 the voltage on the coronode can be held constant and the D.C. drum current can be held constant with the same two light dependent resistors 194 and 204. This circuit then permits a number of dicrotrons 13, each with its own alternating current and direct current regulators, to be operated from the same central alternating current supply.

While the circuits of FIGS. 11 through 15 have been shown as employing linear operational amplifiers 198, 208 and 24 to effectuate voltage and current regulation, the circuits depicted work equally well and at higher efficiency with variable pulse width regulators, such as the regulator 102 in FIGS. 4 and 5. Where such variable pulse width regulators are employed, the transistors 206 and 207 are unnecessary, as they are included in the pulse width regulator chip 102.

The present invention concerning the control of high voltage power supplies utilizing light depending resistors can take other forms and many other variations thereof will become readily apparent to those skilled in the art. Accordingly, the invention should not be considered limited to the specific embodiments of the disclosure herein, but rather is defined in the claims appended hereto.

I claim:

1. An electrical current regulator for a corona discharge device having a coronode wire, a shield and a plate in which a high voltage alternating current is impressed on said coronode wire, comprising dual parallel connections between said shield and said plate in which said connections each include a light dependent resistor connected in series with unidirectional current blocking means arranged in mutually opposing polarity to conduct current in opposite directions between said shield and said plate, and further including separate illuminating means optically coupled to and electrically isolated from said light dependent resistors, and different reference voltage generating means connected to each of said illuminating means to illuminate said light dependent resistors in response to control signals provided by the associated reference voltage generating means, thereby controlling current flow between said corotron wire and said plate.

2. The electrical current regulator of claim 1 further characterized in that said high voltage alternating current is alternately conducted through each of said dual parallel connections during opposing half cycles thereof, and one of said reference voltage generating means rejects the alternating component of said alternating current, thus generating a direct current component and acts on said direct current component to provide a control signal to the illuminating means associated therewith, and the other of said reference voltage generating means rejects the direct current component therefrom and acts on the alternating current component to provide a control signal to the illuminating means associated therewith.

3. An electrical power regulator for a corona discharge device in which a high voltage electrical voltage supply is connected to a corona discharge device having a wire extending in spaced relation relative both to a plate and to a shield electrically connected to said plate comprising: a light dependent resistor connector in series between said voltage supply and said wire of said corona discharge device, a constant current regulating means including a first differential amplifier, light emitting means connected to the output of said first differential amplifier and positioned in optical communication with said light dependent resistor, dual parallel connections between said shield and said plate in which said parallel connections each include a light dependent resistor connected in series with unidirectional current blocking means arranged in mutually opposed polarity to conduct current in opposite directions between said shield and said plate, a current sensing resistor connected at a junction in series with the aforesaid parallel connections and connected to one input of said first differential amplifier, the other input of which is provided by a voltage reference source, thereby stabilizing the flow of electrical current through the shield circuit.

4. The electrical power regulator of claim 3 further comprising a low voltage power supply;

dual transistor circuits connected to conduct power from said low voltage power supply alternatively to separate light emitting diodes each associated respectively with a single one of said parallel connected light dependent resistors, wherein said transistor circuits are connected to receive a common bias from a second differential amplifier having opposing inputs from a voltage divider connected across said shield and said plate and from a second voltage reference source.

5. An electrical power regulator for a corotron in which a high voltage electrical voltage supply is connected to a corotron having a wire extending in spaced relation relative both to a plate and to a shield electrically connected to said plate comprising:

dual parallel connections between said corotron shield and said plate in which said parallel connections each include a light dependent resistor connected in series with unidirectional current blocking means arranged in mutually opposed polarity to conduct current in opposite directions between said shield and said plate, a first differential amplifier, a current sensing resistor connected at a junction in series with the aforesaid parallel connections and connected to an input of said first differential amplifier, the other input of which is connected to receive a reference input, and the output of which serves as a low voltage source, dual transistor circuits connected to conduct power from said low voltage power source alternatively to separate light emitting diodes each associated respectively with a single one of said parallel connected light dependent resistors, wherein said transistor circuits are connected to receive a common bias from a second differential amplifier having opposing inputs from a voltage divider connected across said shield and said plate and from a second voltage reference source.

6. An electrical power regulator for a corona discharge device in which a high voltage electrical voltage supply is connected to a corona discharge device having a wire extending in spaced relation relative both to a plate and to a shield electrically connected to said plate comprising:

dual parallel connections between said shield and said plate in which said parallel connections each include a light dependent resistor connected in series with unidirectional current blocking means arranged in mutually opposed polarity to conduct current in opposite directions between said shield and said plate, a first differential amplifier, a current sensing resistor connected at a junction in series with the aforesaid parallel connections and connected to an input of said first differential amplifier the other input of which is connected to receive a reference input and the output of which serves as a current source, dual transistor circuits connected to conduct power from said current source alternatively to separate light emitting diodes each associated respectively with a single one of said parallel connected light dependent resistors, wherein said transistor circuits are connected to receive a common bias from a second differential amplifier having opposing inputs from the aforesaid junction and from a voltage reference source.

7. An electrical power regulator for a corona discharge device in which a high voltage electrical voltage supply is connected to a corona discharge device having a wire extending in spaced relation relative both to a plate and to a shield electrically connected to said plate comprising:

dual parallel connections between said shield and said plate in which said parallel connections each include a light dependent resistor connected in series with unidirectional current blocking means arranged in mutually opposed polarity to conduct current in opposite directions between said shield and said plate, a first differential amplifier, an impedence connected in series with said voltage supply and said wire, a first voltage divider connected from the intersection of said impedence and said wire and to ground, with one input from said first voltage divider and with the other input from a first voltage reference source, wherein the output of said first differential amplifier serves as a low voltage source, dual transistor circuits connected to conduct power from said low voltage source alternatively to separate light emitting diodes each associated respectively with a single one of said parallel connected light dependent resistors, wherein said transistor circuits are connected to receive a common bias from a second differential amplifier having opposing input from a second voltage divider connected across said shield and said plate and from a second voltage reference source.

8. An electrical power regulator for a corona discharge device in which a high voltage electrical voltage supply is connected to a corona discharge device having a wire extending in spaced relation relative both to a plate and to a shield electrically connected to said plate comprising:

dual parallel connections between said shield and said plate in which said parallel connections each include a light dependent resistor connected in series with unidirectional current blocking means arranged in mutually opposed polarity to conduct current in opposite directions between said shield and said plate, an impedence connected in series with said voltage supply and said wire, a first voltage divider connected from the intersection of said impedence and said wire and ground, a first differential amplifier, connected with one input from said voltage divider and with the other input from a voltage reference source, the output of which serves as a current source, dual transistor circuits connected to conduct power from said current source alternatively to separate light emitting diodes each associated respectively with a single one of said parallel connected light dependent resistors, wherein said transistor circuits are connected to receive a common bias from a second differential amplifier having opposing inputs from the aforesaid junction and from a second voltage reference source.

* * * * *